US007887263B2

(12) United States Patent
Moffat

(10) Patent No.: US 7,887,263 B2
(45) Date of Patent: Feb. 15, 2011

(54) GROUND ANCHOR

(76) Inventor: Miles Edward Moffat, 29 Ramahana Road, Huntsbury, Christchurch (NZ)

( * ) Notice: Subject to any disclaimer, the term of this patent is extended or adjusted under 35 U.S.C. 154(b) by 0 days.

(21) Appl. No.: 12/521,586

(22) PCT Filed: Feb. 29, 2008

(86) PCT No.: PCT/NZ2008/000038

§ 371 (c)(1),
(2), (4) Date: Jun. 29, 2009

(87) PCT Pub. No.: WO2008/115078

PCT Pub. Date: Sep. 25, 2008

(65) Prior Publication Data

US 2010/0001242 A1 Jan. 7, 2010

(30) Foreign Application Priority Data

Mar. 19, 2007 (NZ) ..... 553958

(51) Int. Cl.
*E21D 20/00* (2006.01)

(52) U.S. Cl. ..... 405/259.1; 175/388; 175/391; 175/394; 52/157; 52/155

(58) Field of Classification Search ..... 405/259.1, 405/241, 252.1; 175/388, 391, 394; 52/157, 52/148, 155, 166; 411/426; 254/243, 244
See application file for complete search history.

(56) References Cited

U.S. PATENT DOCUMENTS 2,603,319 A 7/1952 Dyche
5,171,108 A * 12/1992 Hugron ..... 405/259.1
5,322,386 A * 6/1994 Trangsrud ..... 405/19
5,513,978 A * 5/1996 Eimerman et al. ..... 428/10
5,720,579 A * 2/1998 Trangsrud ..... 405/244
5,775,037 A * 7/1998 James ..... 52/163
5,850,715 A 12/1998 Francis
5,927,905 A 7/1999 van Halteren
5,930,959 A 8/1999 van Halteren
D420,891 S * 2/2000 Trangsrud ..... D8/354
6,237,289 B1 * 5/2001 Jewett et al. ..... 52/163
6,238,143 B1 * 5/2001 Zablonski ..... 405/259.1
6,824,331 B2 11/2004 Parker
D572,546 S * 7/2008 Stahm ..... D8/1
7,611,129 B1 * 11/2009 Stahm ..... 254/243
7,713,003 B2 * 5/2010 Agg ..... 405/259.1

* cited by examiner

*Primary Examiner*—Emmanuel M Marcelo
(74) *Attorney, Agent, or Firm*—Galbreath Law Offices, P.C.; John A. Galbreath

(57) ABSTRACT

A cable guide mechanism configured to be releasably attached to a shaft, which includes a body portion, an indent or groove and a protrusion, characterised in that said indent or groove is located on the opposite side of the body portion to the protrusion, and is dimensioned and configured to releasably retain an inside edge of a first distal end of a loop which is attached to a terminal end of a cable; the protrusion is tapered with its widest section directly opposite the indent or groove; the linear distance between the bottom of the indent or groove and the widest section of the protrusion is sufficiently close to the inside length of the loop that in use the first distal end of the loop cannot climb out of the indent or groove; said shaft is configured to freely rotate co-axially inside the cable guide mechanism.

15 Claims, 5 Drawing Sheets

GROUND ANCHOR

TECHNICAL FIELD

The present invention relates to a ground anchor. More specifically, the present invention relates to a ground anchor for use in moving a stranded vehicle.

BACKGROUND ART

There are a number of ground anchors available on the market with different configurations and applications. Some ground anchors are designed to assist with moving a stranded vehicle, most commonly in off-road use, when a vehicle becomes immobilised, and no natural anchor point is available.

One type of vehicle recovery ground anchor that is commonly used is a pole and rope system. In this system, an end of the pole is inserted into the ground, in front of the stranded vehicle. The first end of a rope is then attached to the exposed end of the first pole, and the second end of the rope is attached to the top of a second pole that is inserted into the ground. With the rope attached, the second pole is inserted into the ground, in a line parallel to the first pole. The rope and pole attachment is then repeated with a second rope and third pole, and the third pole is attached to a winch on the vehicle via another rope. By using a number of poles, this system acts to distribute the load between the poles, and provide additional support. However, this system has a number of disadvantages. For example, the anchor only provides a limited amount of support before the poles are pulled from the ground by the load incurred once the vehicle is winched forward. This is due to the angle of force applied to the anchor and the shallow placement of the poles, into the ground. As may be appreciated from the above, this rope and pole arrangement can be complicated to set up, as the right angles for the poles and rope need to be found before sufficient support can be found. The arrangement also requires the user to carry three poles, rope and a means for inserting the poles into the ground, such as a sledge hammer. Therefore, this anchor system can be bulky and heavy to transport.

Other common types of vehicle recovery ground anchors available use a triangular plate that furrows into the ground. Examples of this system include; The Pull-Pal® Ground Winch as described in U.S. Pat. No. 5,850,715, the SARCATM Portable Rescue Tree™, and the Straight Forward™ ground anchor. These systems all use a triangular plate with at least one attachment arm and a line. When in use, a pulling force is applied to the line via a winch on the vehicle, which then pulls onto the arm and plate, causing the anchor to furrow into the ground. One disadvantage of these systems is that they are bulky and heavy owing to the high degree of strength required from the assembly when a load is applied. In addition, these systems may only be used in specific terrains. If the ground is too hard, the tip of the plate has to be manually inserted into the ground, before the anchor can be used. If the ground is too soft, such as in sand, the anchor is pulled through the ground, rather than fixing in position to act as an anchor point. Additionally, all of the above systems have a limited range of depth that the anchor can penetrate the ground, therefore resulting in these anchors gripping the softest top soil.

Other systems that are also available on the market, which penetrate at a deeper level, involve a shaft and auger combination, with a line attached to the shaft. One problem with these anchors is that the line is prone to twisting around the shaft, when the shaft is twisted into the ground. To address this problem, some alternative configurations have been developed.

U.S. Pat. No. 6,824,331 (US'331) describes a configuration with a hollow shaft, where the line runs through the shaft aperture and attaches. to the auger. A problem with this configuration is that when the anchor is in use, the force is applied to the anchor above the ground; this reduces the amount of force that can be applied to the anchor, before the anchor is pulled up out of the ground.

U.S. Pat. No. 5,927,905 is another shaft, auger and line system. The line is coiled around a portion of the shaft, close to the auger at one end of the shaft-before extending up through the shaft. This system has a similar problem to the anchor described in the US'331 patent, as the line is attached to the ground anchor above the ground. This configuration also increases the chances of the coil becoming stuck and tangled in the shaft or surrounding soil, or the anchor being pulled up out of the ground.

A number of other systems, such as those described in U.S. Pat. No. 5,930,959 (US'959) and U.S. Pat. No. 2,603,319 (US'319) attach the line close to the auger portion without running the line through the shaft. As shown in US'959, the line is attached in the middle of the auger. Although there is a gap in the auger blades, this configuration still has a problem of the line getting caught and even bent or cut by the auger blades, particularly if the anchor needs to be screwed in further and/or when the anchor is removed from the ground.

The anchor-described in US'319 attaches the line to a swivel portion above the auger portion. This system allows the line to swivel around the shaft without getting caught and wrapped around the shaft. However, the line is only attached by threading and tying the line through a hole in the swivel portion. Although this configuration may prevent the line from wrapping around the shaft, there is still a chance that the swivel portion may jam, subsequently causing the line to start wrapping around the shaft. This connection technique suits a permanent installation, or light load application, under heavy load conditions the anchor could fail to hold due to the connection between the line and the swivel portion. As the load is applied the section of line through the hole will tend to kink thus weaken the line (there is no easy way of using a thimble to prevent this). In addition the method of connecting the free end of the line to form the loop needs to be carefully chosen so that it does not reduce the strength of the line significantly. Only wire rope clips are shown or described in US'319, and these are one of the few connection devices that can easily and quickly be used for forming a loop in a line without specialist tools so this makes sense, other methods are available but most of these are permanent. To operate correctly and maintain maximum strength clip manufacturers prescribe the number and spacing of the clips required to form a strong joint. Even properly used (the bolts tightened with a torque wrench) they have an efficiency of around 75%-85% of the original line breaking strain thus any operation close to this could cause the clips to fail. In a vehicle recovery situation it is unlikely that wire clips will be properly applied, given the number, spacing and assembly requirements. If clips are used most manufacturers do not recommend they are reused this increases the cost if the cable is not permanently connected to the cable. This configuration also has a point of weakness where the line is attached to the shaft. Therefore, only a small amount of force can be applied to this anchor, before the anchor is pulled out of the ground.

Additionally, all of the above systems are designed for light work, as the systems incorporate light weight components and a light rope that would be easily pulled up out of the ground, under heavy load.

Therefore, it should be appreciated that it would be an advantage to have a device where the ground anchor can easily insert into the ground, without the cable breaking, being bent or damaged, or twisting around the shaft. It would also be an advantage to have a device that was lightweight, and yet provides the strength and ground holding ability to withstand the forces applied when winching a stranded vehicle. Also, having an anchor that could be used in various types of terrain, such as both hard soil and sand, would be an advantage. It would further be an advantage if the device could be releasably connected to a cable with a loop at one end.

It is an object of the present invention to address one or more of the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF INVENTION

The present invention provides a cable guide mechanism configured to be releasably attached to a shaft, which includes a body portion, an indent or groove and a protrusion, characterised in that said indent or groove is located on the opposite side of the body portion to the protrusion, and is dimensioned and configured to releasably retain an inside edge of a first distal end of a loop which is attached to a terminal end of a cable; the protrusion is tapered with its widest section directly opposite the indent or groove; the linear distance between the bottom of the indent or groove and the widest section of the protrusion is sufficiently close to the inside length of the loop that in use the first distal end of the loop cannot climb out of the indent or groove; said shaft is configured to freely rotate co-axially inside the cable guide mechanism.

Preferably said indent or groove is configured and dimensioned to allow the first distal end of the loop to act as a centre of rotation for said loop.

Preferably the shaft includes a first stop means configured to prevent the cable guide mechanism moving co-axially along the shaft towards a first distal end of the shaft. In a highly preferred form the shaft includes a second stop means configured to prevent the cable guide mechanism moving co-axially along the shaft towards a second distal end of the shaft. In a highly preferred form the or each stop means is a disc of material attached to the shaft. In one embodiment the first stop means and second stop means are spaced apart on the shaft such that the cable guide mechanism has limited co-axial movement along the shaft.

In a highly preferred form the cable guide mechanism is co-axially split into two releasably connected sections. Preferably the sections are releasably connected by one or more attachment means selected from the list consisting of screws, Allen screws, spring clips, pins, adhesive and machined keyways The invention also provides a ground anchor including the shaft and releasably attached cable guide mechanism, the ground anchor further includes an anchor means, such that said anchor means is configured to assist in inserting and anchoring the ground anchor when in use. In a preferred form the anchor means is at the first distal end of the shaft. In a highly preferred form the first stop means is immediately adjacent the anchor means. In a preferred form the anchor means includes an auger of known type, a spade like or arrow-head shaped plate or similar.

Preferably the shaft includes a primary shaft and a shaft portion, the shaft portion is releasably attached to the primary shaft and forms the first distal end of the shaft. In a highly preferred form the primary shaft and shaft portion are attached in such a way as to essentially prevent differential rotation of the primary shaft relative to the shaft portion, Preferably the shaft portion includes all, or part of, the anchor means. The second stop means is configured to prevent the cable guide mechanism from moving towards the anchor means. In a highly preferred form-the shaft portion also includes the first stop means. In a highly preferred form the shaft portion is releasably attached to the primary shaft.

In an alternative form the second stop means is formed by an exposed end of the primary shaft.

In a preferred form the primary shaft includes two or more releasably connected lengths of material. In a highly preferred form each length of material is releasably connected to the adjacent length of material, or the shaft portion, by a socketed joint, such that each socketed joint is configured to prevent differential rotational motion of adjacent lengths of material, or the shaft portion. Preferably each socketed joint consists of two mating rectangular, square or hexagonal section tubes.

In a highly preferred form a second distal end of the shaft includes a handle. In a preferred form the handle includes a loop formed in the second distal end and a second shaft, such that the loop is configured to releasably connect the second shaft perpendicular to the shaft. In an alternative form the handle is a Tee-bar handle that is releasably attached to the second distal end.

The present invention also provides a kit that includes the cable guide mechanism, a shaft including two or more lengths of material and a shaft portion including an anchor means.

It should be appreciated from the above description that preferred embodiments of the present invention may have a number of advantages over the prior art which may include:

- a simple configuration;
- a mechanism designed to organise the movements of a cable located around a shaft;
- a lightweight anchor that still provides considerable strength and ground holding ability; and;
- can be used in various types of terrain, including hard soil and sand.

BRIEF DESCRIPTION OF DRAWINGS

Further aspects of the present invention will become apparent from the following description which is given by, way of example only and with reference to the accompanying drawings in which.

BEST MODES FOR CARRYING OUT THE INVENTION

Figure 1:
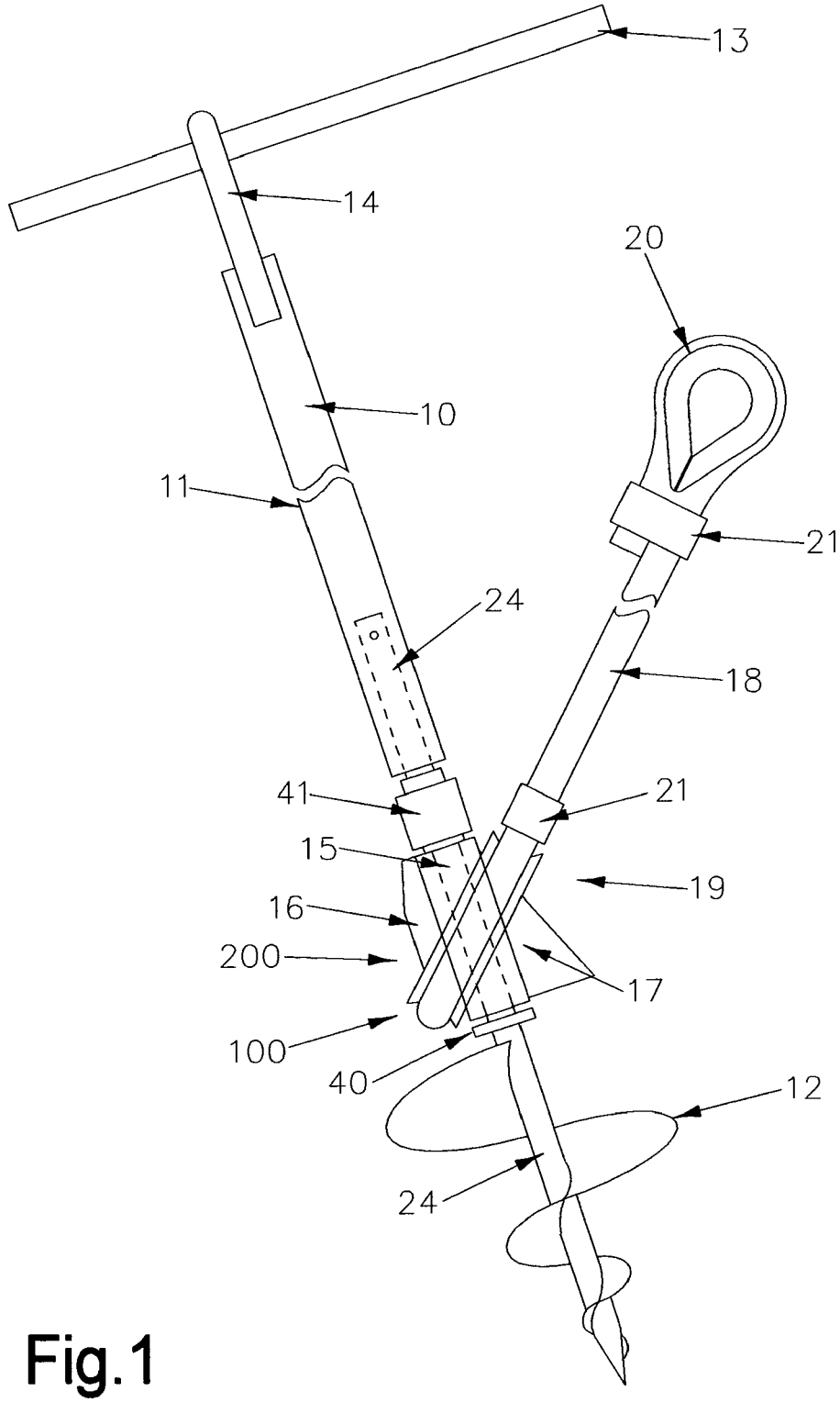
FIG. 1 shows a side plan view one preferred embodiment of the ground anchor with a cable attached to the cable guide mechanism.
Figure 5:
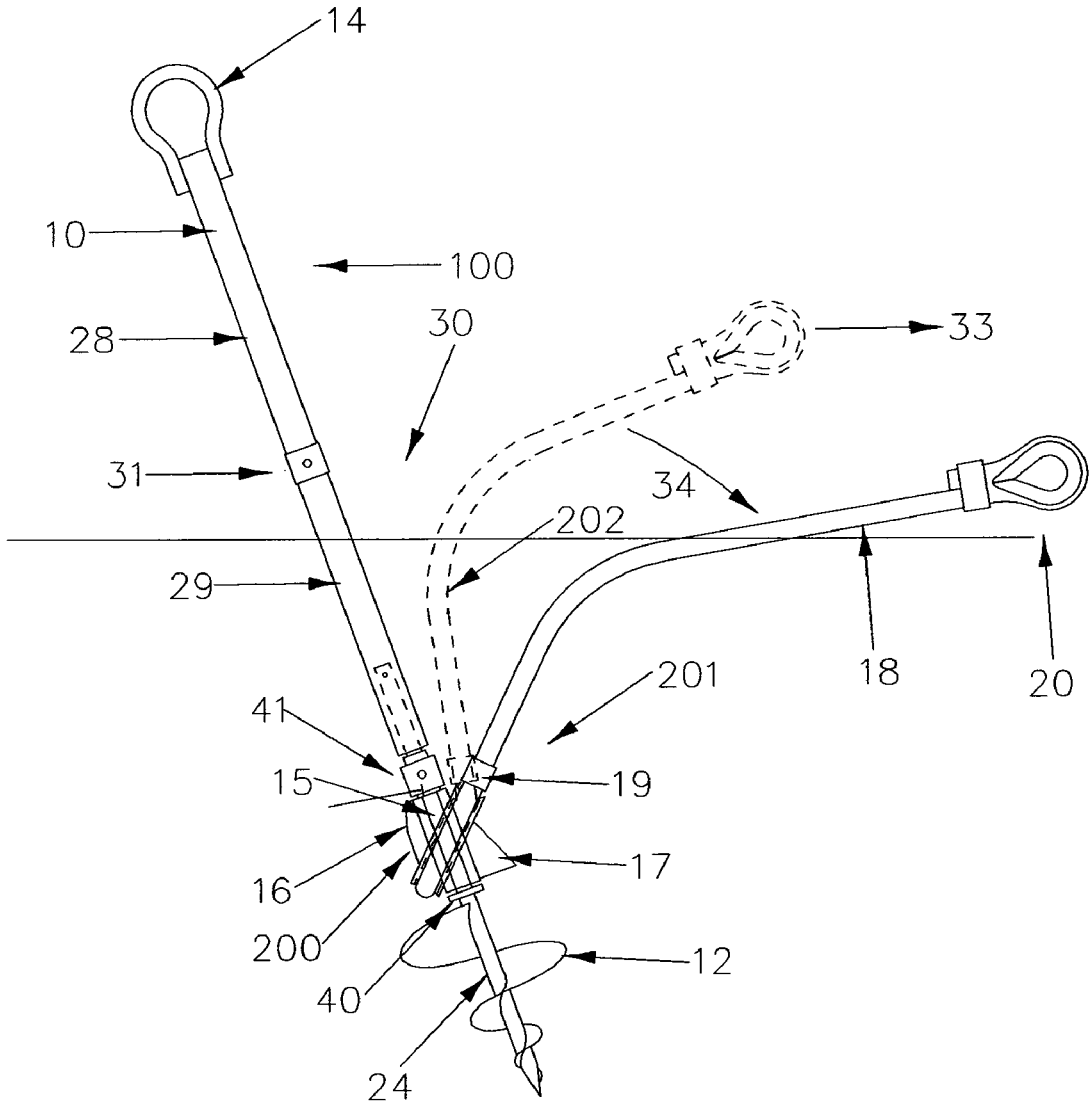
FIG. 5 shows a side plan view of the ground anchor while in use with a cable attached to the cable guide mechanism.

With reference to FIGS. 1 and 5, there is shown a ground anchor referred to by arrow 100. With reference to all Figures, there is a cable guide mechanism as referred to by arrow 200.

Referring to FIG. 1, a ground anchor 100 is shown. The ground anchor 100 has a shaft 10. The shaft 10 may vary in length, as indicated by the break in the shaft indicated by arrow 11. Located at the first distal end of the shaft 10 is an extension in the form of an auger 12 on a solid shaft portion 24, for assisting insertion of the ground anchor 100 into the ground (not shown). The auger 12 is attached to the shaft-10 via the shaft portion 24 extending from the auger 12 into the shaft 10. Preferably, the top distal end of shaft portion 24 has a tapered square shape, which slots into a portion of shaft 10, which is cylindrical. It would be appreciated by a person skilled in the art that in this configuration shaft portion 24 will then be held in place within shaft 10. Located at the second distal-end of the shaft 10 is a handle 13. The handle 13 is a metal tube attached to the shaft 10 via a rigid loop 14, through which the handle 13 is inserted. Also located on the shaft 10 of the ground anchor 100 is a cable guide mechanism 200. The cable guide mechanism 200 has a body portion, as indicated by line 15, and two protrusions, a first protrusion 16 and a second protrusion 17. Also attached to the ground anchor 100 is a cable 18. The cable 18 has two loops (indicated by lines 19 and 20 respectively) at each end of the cable 18. The loops 19 and 20 are retained by gripping devices 21, which receive and retain a length of the cable 18 in a loop. The loops 19 and 20 have a teardrop shape, with a wide body portion (indicated by arrow 26) and a narrow portion (indicated by arrow 27). The cable 18 is attached to the ground anchor 100 via the first loop 19 of the cable 18, which encloses around the cable guide mechanism 200 of the ground anchor 100.

Figure 2:
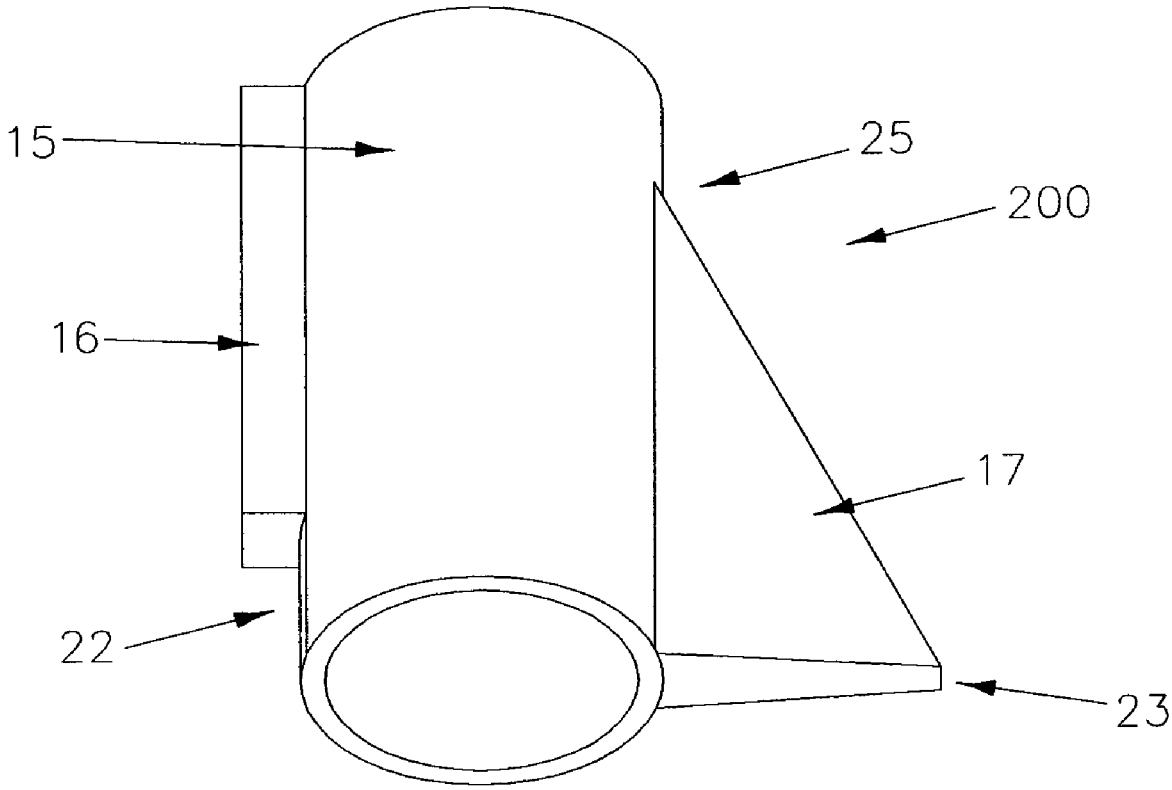
FIG. 2 shows a perspective side view one preferred embodiment of the cable guide mechanism.
Figure 3:
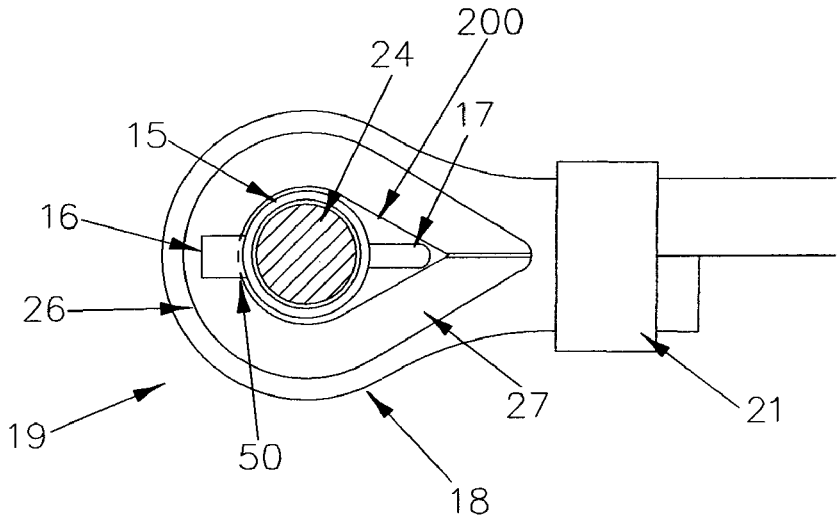
FIG. 3 shows a top plan view one preferred embodiment of the cable guide mechanism.
Figure 4:
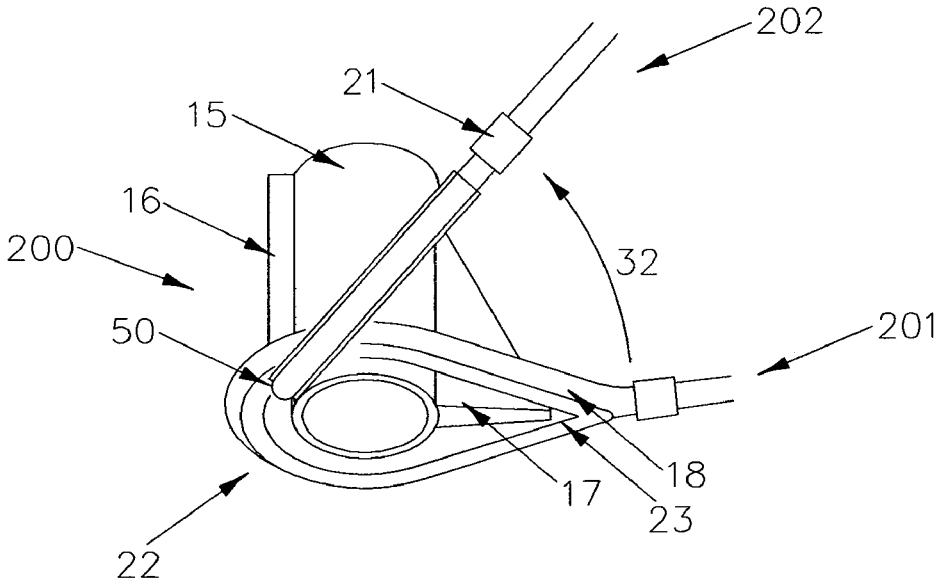
FIG. 4 shows a perspective side view one preferred embodiment of the cable guide mechanism and the cable while in use.

FIGS. 2, 3 and 4 show various views of the cable guide mechanism 200 independent to the ground anchor 100. Shown in these Figures is the body portion 15, the first protrusion 16 and the second protrusion 17 of the cable guide mechanism 200. As shown in these Figures, the body portion 15 is in the form of a hollow tube.

As shown in FIG. 2, the first protrusion 16 is indented (as indicated by arrow 22) from the first distal end of the body portion 15 of the cable guide mechanism 200. The second protrusion 17 is tapered, with the widest end (as indicated by arrow 23) of the second protrusion 17 being located at the first distal end of the body portion 15 and the narrow portion (as indicated by line 25) being located towards the second distal end of the body portion 15.

FIG. 3 shows a plan view of the top of the cable guide mechanism 200. The body portion 15, the first protrusion 16 and the second protrusion 17 are all shown. Shown in this Figure the cable guide mechanism 200 is enclosed around the shaft 10 and/or shaft portion 24 of the ground anchor 100 and the auger (not shown) respectively. The first loop 19 of the cable 18 surrounds the outside of the cable guide mechanism 200. As shown, the wide portion 26 of the loop 19 sits within the indent 22 of the first protrusion 16, while the narrow portion 27 of the loop 19 sits around the second protrusion 17.

Now referring to FIG. 5, the ground anchor 100 is shown in use. Generally, the ground anchor 100 will be in a number of pieces that require assembly. In other variations, the ground anchor 100 may be one tool that does not require assembly. To configure the ground anchor 100, first the auger 12 is selected. The first loop 19 of the cable 18 is positioned around the shaft portion 24 of the auger 12. The cable guide mechanism 200 is then positioned onto the shaft portion 24 of the auger 12. It would be appreciated that this may be achieved in a number of different ways. Preferably, the cable guide mechanism 200 may be in two halves, which enclose around the shaft 24 and then connect together, by attachment means (not shown) such as two screws, one or more spring clips, a physical configuration that locks together or similar. The cable 18 is then brought up around the cable guide mechanism so the body portion 26 of the loop 19 of the cable 18 is placed within the indent 22 of the first protrusion 16 and the narrow portion 27 of the loop 19 is positioned around the second protrusion 17, with the widest end 23 of the protrusion sitting substantially inside the narrow portion 27 of the cable loop 19. The shaft 10 of the ground anchor 100 is then attached to the shaft 24 of the auger 12. If the shaft 10 comprises of two or more lengths of material, (as in FIG. 5, lines 28 and 29) these lengths of material are connected together, as required.

Once the ground anchor 100 is assembled, the anchor 100 can be inserted into the ground 30, at a sufficient distance away from the vehicle (not shown) to be pulled. To insert the anchor 100 into the ground 30, the handle 13 is inserted through the loop 14. The ground anchor 100 is then positioned in-place, by holding the ground anchor 100 angled slightly away from the vehicle (not shown) but substantially at right angles to the surface of the ground 30. The auger 12 and shaft 10 are then twisted into the ground by turning the handle 13. As the anchor 100 is twisted into the ground 30, the cable. guide mechanism 200 and the cable 18 follow into the hole 31 that is formed by the auger 12.

FIG. 4 shows a detailed view of the cable 18 and cable guide mechanism 200, while the cable guide mechanism is inserted into the ground 30. Before the cable 18 and cable guide mechanism 200 are inserted into the ground, the loop 19 of the cable 18 sits at a 90° angle to the axis of the body portion 15, in the orientation indicated by arrow 201.

When the ground anchor 100 is twisted into the ground 30, cable 18 is pulled through the hole 31 that is formed by the auger 12. The narrow portion 27 of the loop 19 moves towards the shaft 10, in the direction indicated by arrow 32, while the wide body portion 26 of the loop 19 is held at the first distal end of the body portion 15 of the cable guide mechanism 200. When the ground anchor 100 is fully inserted into the ground 30, the cable 18 then runs in a position substantially parallel to the shaft 10 of the ground anchor 100, at an orientation as indicated by arrow 202.

By allowing the cable guide mechanism 200 to rotate independently (or remain stationary in relation to) to the shaft 10, and having the particular configuration of the two protrusions 16, 17, prevents the cable 18 from wrapping around the shaft 10, while the ground anchor 100 is inserted into the ground 30.

Once the ground anchor 100 is at a depth that can sufficiently hold the vehicle (not shown), the handle 13 is removed and the second loop 20 of the cable 18 is attached to the vehicle (not shown) or an additional cable (not shown) that is then attached to the vehicle. Once the cable 18 is attached to the vehicle (not shown), the cable 18 can be winched pulling the vehicle forward. When a load is put on the cable 18, the cable 18 will pull in the direction, as indicated by arrow 33, towards the vehicle (not shown). This will force the cable 18 through the ground 30, in the direction indicated by arrow 34. Given that the ground anchor 100 is sufficiently anchored in place, this provides enough tension to prevent the ground anchor 100 from moving out of position. This is achieved as the cable 18 acts to pull the ground anchor 100 substantially horizontally through the ground rather than at a vertical angle out of the ground.

As shown in FIGS. 1 and 5 the shaft portion 24 includes a first stop means 40 and a second stop means 41. Each stop means 40, 41 is a disk of material dimensioned and they are spaced apart such that, in use, the cable guide mechanism's 200 co-axial movement along the length of the ground anchor 100 is constrained. The internal diameter of the body portion 15 is such, when the cable guidance mechanism is installed on the ground anchor 100, that it forms a clearance fit with the shaft portion 24. The first stop means 40 is configured to prevent the cable guide mechanism 200 from moving along the shaft portion 24 towards the auger 12. Similarly the second stop means 41 is configured to prevent the cable guide mechanism 200 from moving along the shaft portion 24 towards the centre of the shaft 10.

Figure 6:
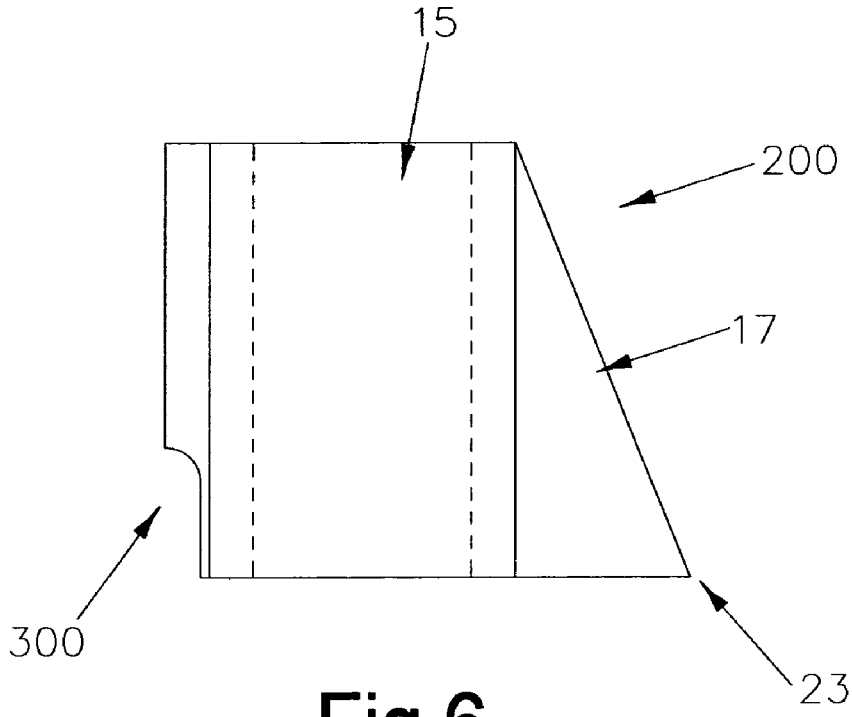
FIG. 6 is a side view of a second embodiment of the cable guide mechanism.

In a second embodiment of the cable guide mechanism 200, as shown in FIG. 6, there is no first protrusion 16, instead the indent 22 is a groove 300 cut in the wall of the body portion 15. The groove 300 is deep enough to retain the body portion 26 of the loop 19, but not deep enough to allow the loop 19 to contact the shaft portion 24 of the auger 12 (i.e. the groove 300 extends only partially through the wall of the body portion 15). The wall thickness of the body portion 15 may vary so that the groove 300 is cut into a thicker wall section of the body portion 15.

Figure 7:
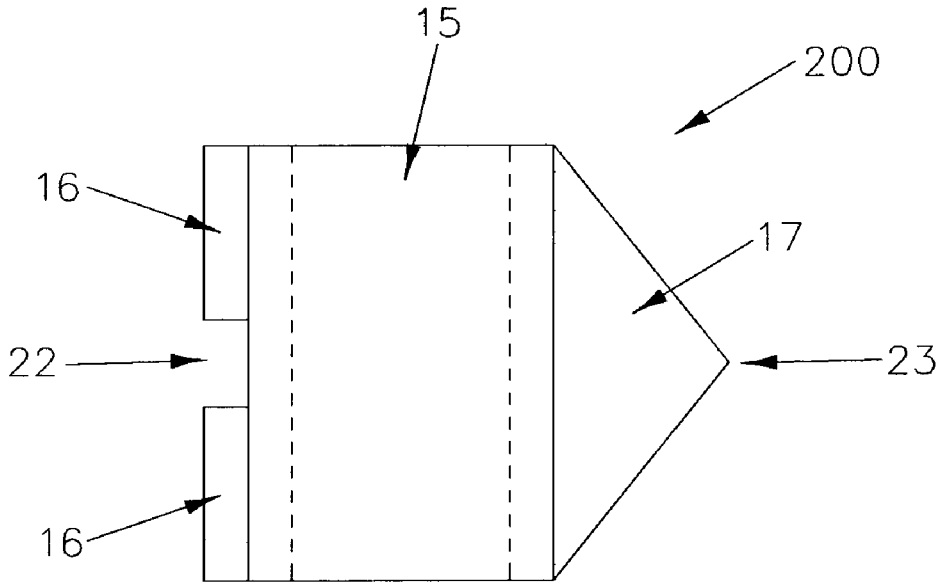
FIG. 7 is a side view of a third embodiment of the cable guide mechanism.

In a third embodiment of the cable guide mechanism 200, as shown in FIG. 7, the indent 22 is located at the centre (equidistant from each distal end of the body portion 15) of the first protrusion 16. In this embodiment the second protrusion 17 is widest, i.e. extends furtherest from the body portion 15, at a point opposite the indent 22 (equidistant from each distal end of the body portion 15), this has been labelled 23 to be consistent with the first embodiment. This makes the cable guide mechanism 200 symmetrical so that it can be used either way up on the ground anchor 100 shaft 10 and/or shaft portion 24.

In a further embodiment (not shown) the ground anchor 100 does not include an auger 12, it is instead driven straight into the ground by known means (such as a post hammer, sledge hammer, hydraulic press or similar). The auger 12 in this embodiment is replaced with an alternative anchor means (not shown) such as a spade or. arrowhead like section. In a further embodiment the cable guide mechanism 200 is not split and assembled onto the shaft portion 24, instead the second stop means 41 is removable. It could be C shaped and fit into a matching groove in the shaft portion 24, it could include a tab which is inserted into a matching aperture in the shaft portion 24.

In a further embodiment the attachment means is an adhesive that forms a bond sufficiently strong enough to hold the cable guide mechanism together while in use, but able to be mechanically separated, or chemically dissolved, after use.

In all embodiments the distance between the base of the indent 22, or groove 300, and the widest point 23 of the second protrusion 17 is such that, once the loop 19 is in place around the cable guide mechanism 200, the distal end 50 of the loop 19 closest to the wide portion 26 of said loop 19 cannot rise up the ground anchor 100. In use the distal end 50 closest to wide body portion 26 of the loop 19 is retained in the indent 22, or groove 300, and acts as a centre of rotation for the loop 19.

In use, as the ground anchor 100 is inserted into the ground 30, the cable guide mechanism 200 retains the distal end 50 of the loop 19. As the ground anchor 100 is inserted further into the ground 30 the narrow portion 27 of loop 19 moves along a curved path along arrow 32 until the narrow portion 27 contacts the body portion 15 causing the cable 18 to be pulled into the ground approximately in line with the shaft 10. The wall thickness of the body portion 15 is dimensioned such that the loop 19 preferably contacts the body portion 15 only at the distal end 50 and the narrow portion 27 of loop 19. As the ground anchor 100 is inserted into the ground 30 the cable guide mechanism 200 remains essentially, rotationally, stationary with respect to the shaft portion 24, or shaft 10, which prevents the cable 18 from wrapping around the ground anchor 100. The second stop means 41 prevents the cable guide mechanism from moving along the shaft portion 24, or shaft 10, towards the surface of the ground 30.

Once the ground anchor 100 has been fully inserted into the ground the load can be applied to the cable 18 (by power or hand winch or other similar device). It is believed that as the load is applied it is transferred through the cable 18 to the cable guide mechanism 200 by loop 19 and onto the shaft portion 24, and/or shaft 10. As the load increases the cable 18 is pulled down into the ground 30 until the force required to pull it further is greater than that required to move the vehicle or pull the ground anchor 100 out of the ground 30. Then, once the cable 18 has been pulled into the ground 30 as far as possible the load is transferred to the ground anchor 100. With the cable guide mechanism 200 transferring the load to the shaft portion 24, and/or shaft 10, and the cable guide mechanism 200 being located close to the auger 12, it is thought that most of this load is transferred to the auger 12 rather than the shaft 10.

Once the vehicle has been extracted the ground anchor 200 is extracted from the ground 30, the first stop means 40 preventing the cable 18 from becoming entangled with the auger 12.

The protrusions 16,17 may be strips of material welded, glued or otherwise permanently attached to the body portion 15. Alternatively the cable guide mechanism 200 can be an extruded section with the protrusions 16, 17 integrally formed. The hole through the body portion 15, is dimensioned to be a clearance fit with the shaft portion 24 or shaft 10 and, may be aligned with the centreline of the body portion 15 or off to one side (i.e. eccentric). It should be noted that where the term loop 19,20 is used this refers to the terminal eye (or eyes) in cable 18 and is intended to include other cable termination devices (for example poured sockets and swaged connectors) that form closed loop at a terminal end of a cable 18 or are hooks that include a latch such as safety hooks. The gripping device 21 can be a ferrule, wire rope clips or similar means of standard type used to join two pieces of cable together. The term cable is intended to cover wire rope, wire cable, natural fibre ropes, synthetic ropes, synthetic or wire strops, chains with a preformed terminal loop or hook (with or without latch—a safety hook for example) and similar flexible connection/recovery means.

It should be noted that although described with particular reference to a ground anchor 100, the cable guide mechanism 200 could be used for any application where a cable 18 needs to be connected to, but rotationally isolated from, a shaft 10, or shaft portion 24.

From the above description it should be apparent that a ground anchor is described that is light weight, provides sufficient strength and stability for winching a vehicle out of a number of different terrains, including sand.

Aspects of the present invention have been described by way of example only and it should be appreciated that modifications and additions may be made thereto without departing from the scope thereof.

The invention claimed is:

1. A ground anchor including a shaft and a cable guide mechanism, wherein the cable guide mechanism is configured to be releasably attached to said shaft, characterised in that the cable guide mechanism, includes a body portion, an indent or groove and a protrusion, such that said indent or groove is located on an opposite side of the body portion to the protrusion, the protrusion is tapered with its widest section directly opposite the indent or groove; the linear distance between a bottom of the indent or groove and the widest section of the protrusion is dimensioned and configured, when in use, to releasably retain an inside edge of a first distal end of a loop which is attached to a terminal end of a cable such that the loop cannot climb out of the indent or groove; and that said shaft includes a first stop means and an anchor means, wherein said anchor means is at a first distal end of the shaft and configured to assist in inserting and anchoring the ground anchor when in use, and the first stop means is configured to prevent the cable guide mechanism moving co-axially along the shaft towards the first distal end;

wherein said shaft is configured and dimensioned, when the ground anchor is in use, to freely rotate co-axially inside the cable guide mechanism.

2. The ground anchor as claimed in claim 1 characterised in that the indent or groove in the cable guide mechanism is configured and dimensioned to allow the first distal end of the loop to act as a centre of rotation for said loop.

3. The ground anchor as claimed in claim 1 characterised in that the shaft includes a second stop means configured to prevent the cable guide mechanism moving co-axially along the shaft towards a second distal end of the shaft.

4. The ground anchor as claimed in claim 3 characterised in that the first stop means and second stop means are spaced apart on the shaft such that the cable guide mechanism has limited co-axial movement along the shaft.

5. The ground anchor as claimed in claim 3, characterised in that a second distal end of the shaft includes a handle.

6. The ground anchor as claimed in claim 5, characterised in that the handle includes a loop formed in the second distal end and a second shaft, such that the loop is configured to releasably connect the second shaft perpendicular to the shaft.

7. The ground anchor as claimed in claim 1 characterised in that the cable guide mechanism is co-axially split into two releasably connected sections.

8. The ground anchor as claimed in claim 7 characterised in that the sections are releasably connected by one or more attachment means selected from the group consisting of screws, Allen screws, spring clips, pins, adhesive and machined keyways.

9. The ground anchor as claimed in claim 1, characterised in that the first stop means is immediately adjacent the anchor means.

10. The ground anchor as claimed in claim 1, characterised in that the anchor means is selected from the group consisting of an auger, or arrow-head shaped plate.

11. The ground anchor as claimed in claim 1, characterised in that the shaft includes a primary shaft and a shaft portion, the shaft portion is releasably attached to the primary shaft and forms the first distal end of the shaft.

12. The ground anchor as claimed in claim 11, characterised in that the primary shaft and shaft portion are attached in such a way as to essentially prevent differential rotation of the primary shaft relative to the shaft portion.

13. The ground anchor as claimed in claim 11, characterised in that the shaft portion includes all, or part of, the anchor means.

14. The ground anchor as claimed in claim 11, characterised in that the primary shaft includes two or more releasably connected lengths of material.

15. A kit that includes a ground anchor as claimed in claim 1, with the shaft including two or more lengths of material and a shaft portion including the anchor means.

* * * * *